United States Patent [19]

Yoshii et al.

[11] Patent Number: 4,582,531

[45] Date of Patent: Apr. 15, 1986

[54] METHOD OF HEATING A MOLTEN STEEL IN A TUNDISH FOR A CONTINUOUS CASTING APPARATUS

[75] Inventors: Yutaka Yoshii; Yasuhiro Habu; Hiromitsu Yamanaka; Tsunehiro Ueda, all of Chiba, Japan

[73] Assignee: Kawasaki Steel Corporation, Kobe, Japan

[21] Appl. No.: 654,002

[22] PCT Filed: Jan. 18, 1984

[86] PCT No.: PCT/JP84/00007

§ 371 Date: Sep. 12, 1984

§ 102(e) Date: Sep. 12, 1984

[87] PCT Pub. No.: WO84/02863

PCT Pub. Date: Aug. 2, 1984

[30] Foreign Application Priority Data

Jan. 18, 1983 [JP] Japan ..... 58-6091

[51] Int. Cl.[4] ..... C22B 4/00

[52] U.S. Cl. ..... 75/10 R; 75/12; 75/45

[58] Field of Search ..... 75/10, 12, 61, 45

[56] References Cited

U.S. PATENT DOCUMENTS

| | | | |
|---|---|---|---|
| 2,415,974 | 2/1947 | Tama | 75/10 R |
| 2,446,637 | 8/1948 | Crampton | 75/10 R |
| 2,473,311 | 6/1949 | Tama | 75/10 R |
| 2,655,550 | 10/1953 | Zvanut | 75/10 R |
| 3,413,113 | 11/1968 | Vogels | 75/12 |

*Primary Examiner*—Peter D. Rosenberg

*Attorney, Agent, or Firm*—Balogh, Osann, Kramer, Dvorak, Genova & Traub

[57] ABSTRACT

A method of heating a molten steel in a tundish for a continuous casting apparatus while the molten steel being introduced and circulated in a roundabout channel of a horizontal channel type induction heater attached to the side wall of the tundish. This relates to the technique in which electric power is applied to the induction heater depending upon the stored amount of the molten steel in the tundish, for instance, the power is increasingly supplied gradually in the case of the pouring at an initial stage, to effectively eliminate the current interference due to the pinching, and compensate the reduction in the temperature accompanied by the molten steel pouring at the time of the continuous casting.

1 Claim, 11 Drawing Figures

METHOD OF HEATING A MOLTEN STEEL IN A TUNDISH FOR A CONTINUOUS CASTING APPARATUS

TECHNICAL FIELD

The present invention relates to a method of heating a molten steel in a tundish for a continuous casting apparatus. In general, the temperature of the molten steel first received in a tundish is extremely lowered through heat absorption of a refractory material of an inner lining, heat dissipation from a bath surface or the like. Consequently, a part of the cast sheet becomes poor in quality. Therefore, such a temperature drop must be compensated. For this purpose, the present invention is designed to meet the above requirement in such a manner that the above tundish is provided with a horizontal channel type induction heater by which the molten steel is circuitously introduced into the interior of the induction heater to be heated and then returned into the tundish under circulation.

BACKGROUND TECHNIQUE

In the continuous casting, the molten steel is poured into the tundish through a ladle, and undergoes a conspicuous temperature drop due to the heat dissipation from the poured flow, the heat absorption by the inner lining refractory material, and heat radiation from the surface of the bath.

As the ordinary technique which compensates such a temperature drop, there has been a technique disclosed in Japanese Patent Laid-Open No. 163,730/79 in which a vertical type induction heater adapted to vertically circulate the molten metal is attached for heating to the bottom wall of the molten metal storing container. However, since in the technique disclosed therein, the vertical type induction heater is used in the attached state to the bottom wall, it is difficult to use in a tundish for the continuous casting apparatus.

On the other hand, there has been heretofore proposed a technique by which a horizontal channel type induction heater is fitted to the side wall of the tundish, as disclosed in Japanese Patent Laid-Open No. 56,144/82. A skeleton view of the heater used in this technique is shown in FIGS. 1 and 2. The illustrated horizontal channel type induction heater 2 is fitted to the side wall of the tundish 1. The body of the induction heater 2 is constitued by disposing a refractory material 7 inside of a shell 6 defining the outer shell, and has a roundabout or circular channel 8 formed in a loop shape from the inlet port 8*a* to an outlet port 8*b* which are opened to the interior of the tundish 1 and a through hole 9 provided penetrating the central portion surrounded by the roundabout or circular channel 8 in a direction orthogonal to the flowing direction of the molten steel. In FIGS. 1 and 2, a reference numeral 3 denotes the location of a nozzle from which the molten steel is received, a reference numeral 4 an outflow port, and a reference numeral 5 a partition wall for guiding the molten steel flow, which is provided if necessary.

A primary induction coil 10 to generate an induction current i in the molten steel flow within the roundabout or circular channel 8 is assembled through insertion in the inside of the above through hole 9 via a core 10*a*. A magnetic field $\phi$ is produced in the core 10*a* when the primary induction coil 10 is energized, and the secondary induction current i is accordingly flown in the molten steel within the roundabout channel 8, so that a Joule's heat of $i^2 \cdot R$ is produced to heat the molten metal. To put it into another words, the heater is so constituted that the molten steel passage as the roundabout channel 8 is provided to heat the molten steel during the roundabout or circular movement.

However, when this induction heater 2 is used, there have been often experienced that the intended heating of the molten steel may not be appropriately and smoothly performed depending upon the schedule of the power supply to the heater.

That is, when a normal rated electric power is constantly supplied to the coil 10 of the induction heater 2 in the heating of the molten steel, since air is often stayed in the roundabout channel 8 particularly in case that the stored amount of molten steel in the tundish is small, that is, in the initial stage of pouring the molten steel from the ladle to the tundish 1, at which heating is most necessary, the sectional area of the molten steel flow becomes smaller and the secondary induction current density becomes larger in the roundabout channel 8 in which the air is stayed, so that the pinching phenomenon in the roundabout channel 8 becomes conspicuous and in the worst case, the molten steel is cut off in the channel 8 to interrupt the induction current. When the pinching phenomenon becomes conspicuous like this, fluctuation in the electric current flowing through the coil 10 becomes larger so that the electric power necessary for heating the molten steel can not be steadly supplied, and in some cases, there takes place a tripping of the electirc power source. In the case of the electric continuity interruption due to the pinching phenomenon, it takes a long time to recover, and similar electric continuity interruption repeatedly comes to occur. When the above pinching phenomenon becomes more conspicuous, the damage of the refactory material layer is too large to be repaired, and there comes out a possible molten steel leakage. Although restriction of the electric power to be supplied is effective for prevent such a phenomenon, the temperature drop of the molten steel aimed at in the initial stage can not be avoided.

The presence or lacking of the pinching phenomenon accompanied by the properness or improperness of the electric power supply schedule comes into almost no problem in the case of the ordinary vessel for holding the molten metal other than the tundish for the continuous casting. For, in the case of such a holding vessel, it is not late to apply an electric power after the bath surface level is so raised that the electric power may be stably supplied. However, when the temperature drop is large in the pouring initial state in the case of the tundish for the continuous casting, the casting sheet quality is adversely affected. Thus, the control of the electric power supply is indispensable for meeting the requirement that the application of the electric power is harstened at the early stage to facilitate heating.

In this sense, it is necessary to develop technique to effectively prevent the temperature drop by supplying the maximum electric power within a range in which no pinching is caused and at the initial stage of pouring the molten metal into the tundish. It is just an object of the present invention to provide a method of heating the molten steel in the tundish by using horizontal channel type induction heater which meets such a requirement.

DISCLOSURE OF THE INVENTION

The present invention relates to a method of supplying an electric power into an induction heater in such a way that the electric power supplied to the induction heater is made dependent upon the stored amount of the molten steel in the tundish and that the relation between the depth H mm of the steel bath in the tundish (the distance from the upper edge of the roundabout channel to the bath surface) and the induction electric current density D A/cm²/N in the molten steel flow within the roundabout channel meets the following:

$$D \leqq 0.01H + 4.5$$

when the molten steel is introduced into and heated in the channel type induction heater which comprises a roundabout or circular channel arranged in a loop shape communicated with the interior of the tundish and a coil adapted to generate magnetic fluxes interlinking with the molten steel flow flowing inside of the roundabout channel and in which an induction current is produced in the molten steel passing through the roundabout channel by applying the electric current to the coil so as to facilitate heating by the joule's heat thereof. By so supplying the electric power, the trip phenomenon of the secondary induction current flowing through the molten steel flow in the roundabout channel owing to the pinching is avoided, whereby the molten steel in the tundish is stably heated.

BEST MODE FOR WORKING THE INVENTION

The present invention will be explained more in detail with reference to the attached drawings.

Figure 3:
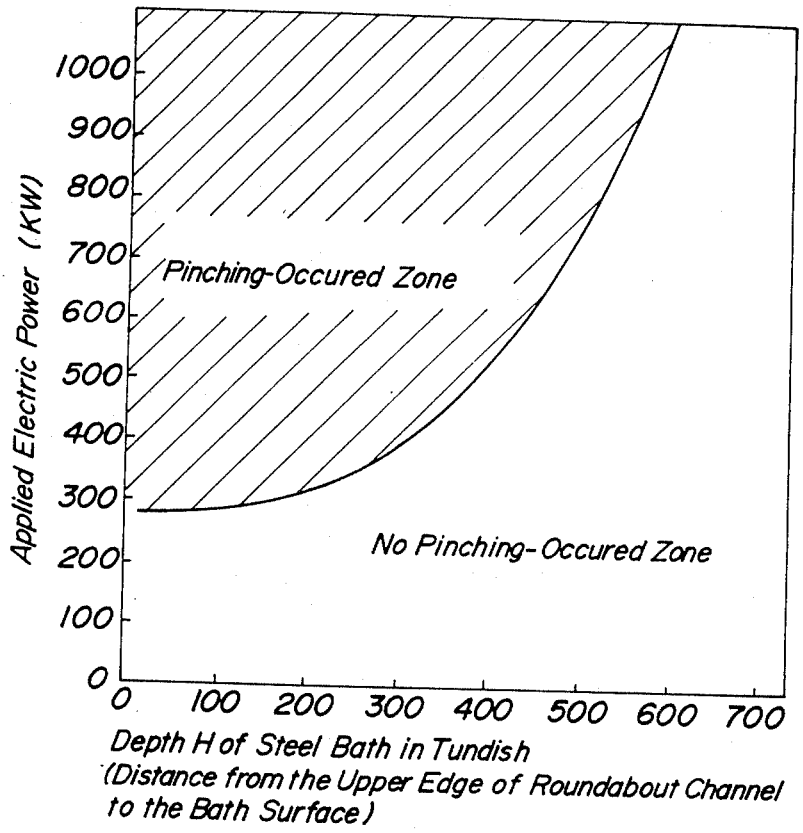
FIG. 3 is a graph illustrating the relation between the depth of a steel bath and the supply electric current in connection with the occurrence of pinching.

FIG. 3 shows the relation between the stored amount of the molten steel in the tundish, that is, the depth H mm of the steel bath in the tundish (the distance from the upper edge of the roundabout channel to the bath surface) and the supply electric power KW to the heater 2. It is understood that there exists appropriate supply electric power which gives no pinching depending upon the depth of the steel bath. In the illustrated embodiment according to the present invention, the sectional profil of the roundabout channel 8 was a long elliptical form of about 100×200 mm with a sectional area of 184 cm². The composition of the molten steel was C/0.1–0.15%, Si/0.25–0.35%, Mn/0.65–1.10%, P/0.01–0.018%, S/0.005–0.010%, Al/0.02–0.03% as an ordinary plate.

Figure 1:
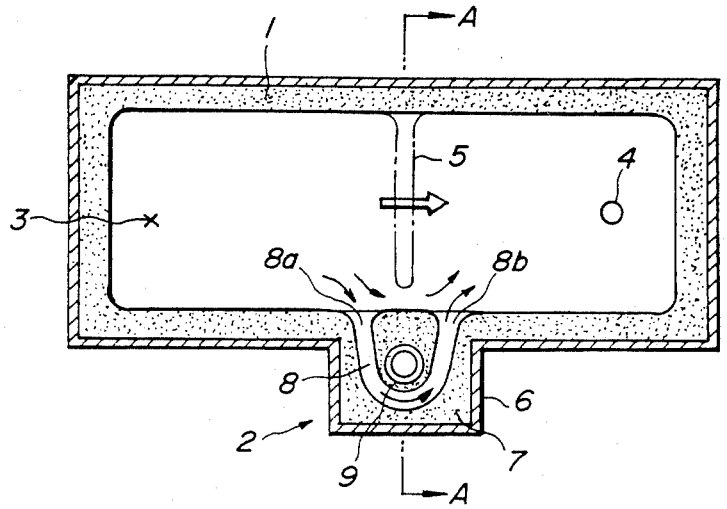
FIG. 1 is a horizontally sectional view of a tundish equipped with an induction heater having a coil removed.
Figure 2:
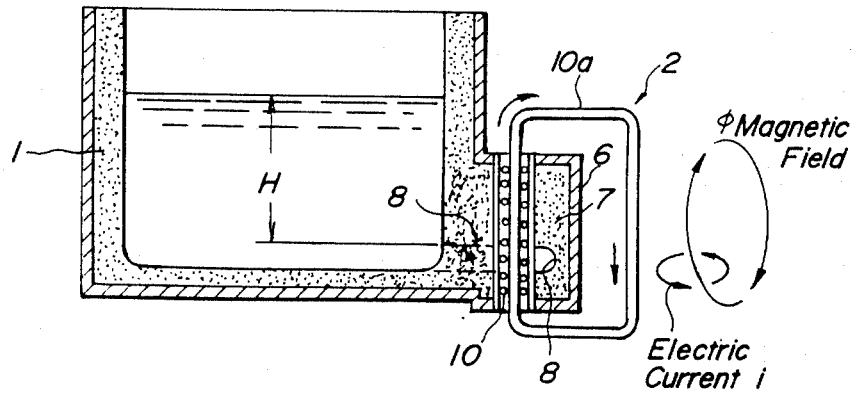
FIG. 2 is a vertically sectional view as viewed from A—A portion in FIG. 1.

On the other hand, when similar experiments were done with respect to a heater with the roundabout channel of a substantially annular sectional profile (100 mm $\phi$) having a sectional area 79 cm² different from that shown in FIG. 1, a slight difference in the pinching occurred zone was observed.

Figure 4:
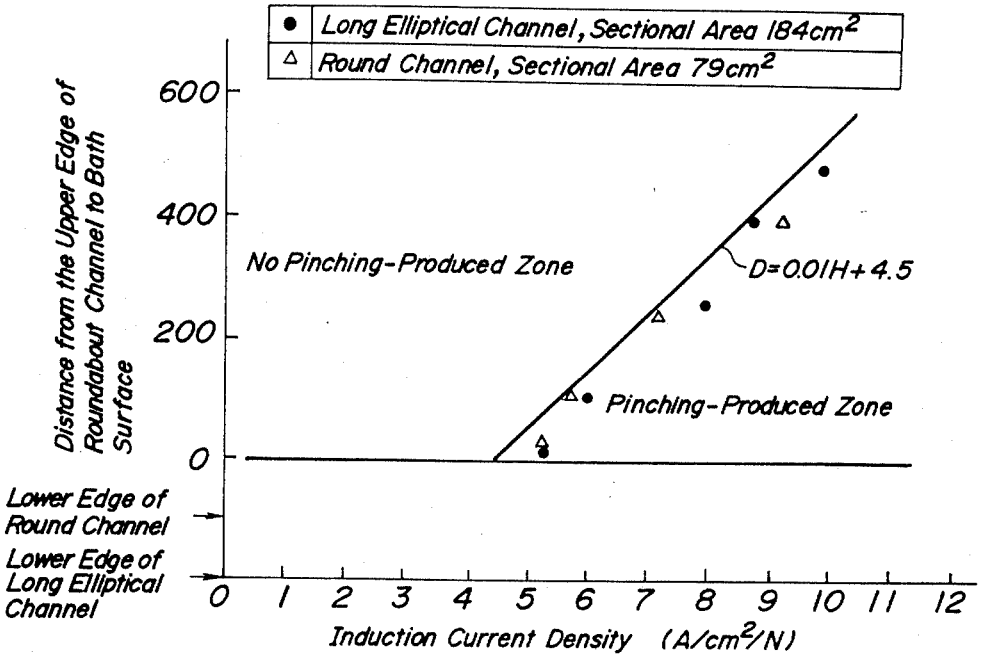
FIG. 4 is a graph illustrating the influence of the induction electric current density (coil and end count N: 22) in different heaters in connection with a pinching occurrence.

Accordingly, as indicated in FIG. 4, examination was similarly done on the relation between the depth H mm of the bath which means the distance from the upper edge of the roundabout channel to the bath surface and the induction electric current density D A/cm²/N in the molten steel flown per one turn of the primary coil with end count of N in connection with the pinching occurrence in two types of roundabout channel 8 of different section profile, it was revealed that the appropriate induction electric current density is constant with respect to the depth H of the steel bath irrespective of the different sectional area.

As a consequence, it is seen from the figure that in any case, the zone which gives the appropriate induction electric current density D A/cm²/N with no pinching produced is the left upper portion in the graph divided by the following formula:

$$D \leqq 0.01H + 4.5.$$

From this, it is made clear that a desirable induction heating is possible at the range at which the electric power is stably supplied, so long as the relation between the appropriate induction electric current density and the depth H is controlled to meet the following relation:

$$D \leqq 0.01H + 4.5.$$

As to the value of D, if it is intended to be in a too small range, the effect aimed at by the invention, that is, the restraining on the decrease in the temperature cannot be attained. Therefore, the operation may be done at conditions near the formula.

Figure 5:
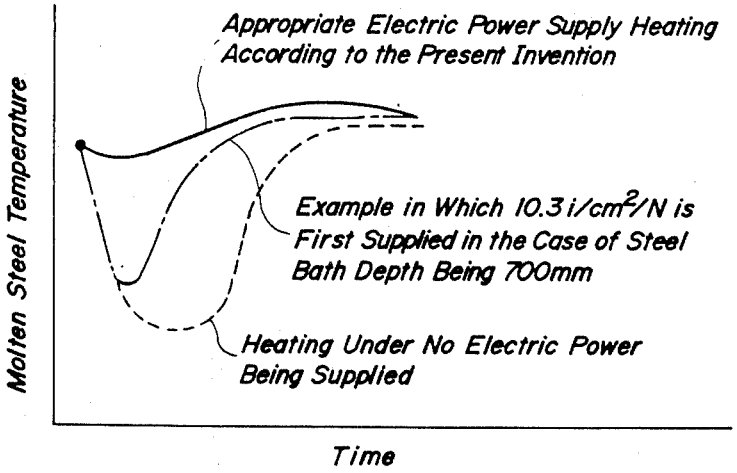
FIG. 5 is a graph illustrating the comparison between the method of the present invention and the conventional method, which influence maintenance of the temperature of the steel bath.

FIG. 5 shows an example in which the molten steel was heated by an appropriate induction electric current value i obtained an example in which an electric current was first passed through the coil 10 such that the induction electric current density may be 10.3 A/cm³/N, after the depth of the steel bath in the tundish reached 700 mm, and an example in which no current was applied.

The drop in the temperature during the initial pouring stage into the tundish is conspicuously small in the case where heating was done while being controlled to an appropriate secondary induction electric current according to the present invention, and a drop in the temperature of the molten steel is more or less observed in the other two examples.

Next, an example to which the invention is applied at the pouring initial stage will be explained below. In the following description, the stored amount of the molten steel in the tundish, that is, the depth H mm of the steel bath, is represented by the pouring time min. (lapse of time after pouring) under the conditions that the pouring flow rate of the molten steel per time was kept constant.

Figure 6A:
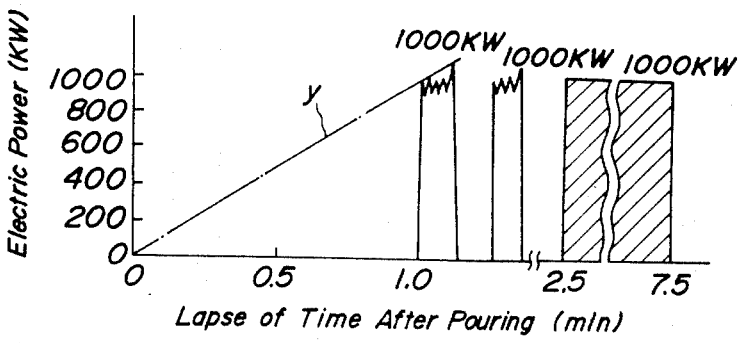
FIGS. 6*a* and *b*, FIGS. 7*a* and *b*, and FIGS. 8*a* and *b* are each a graph between an electric power supply pattern to the induction heater and molten metal temperature shifting caused thereby.
Figure 6B:
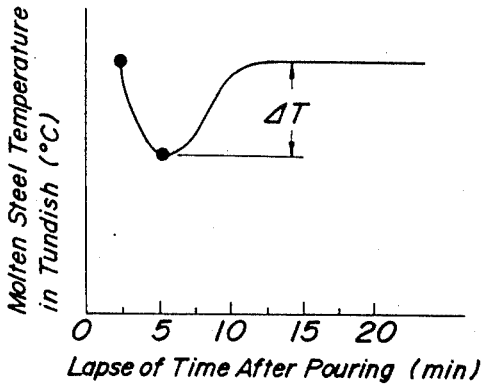

An operation experiment was done at a pouring flow rate 7 tons/min by using a tundish 1 of volume 7 tons (the depth of the bath being 600 mm in the full charging). When the maximum electric power was applied by the induction heater 2 of the normal rated output 1,000 KW/minute after pouring was begun, the above-mentioned pinching was produced as shown in FIG. 6*a*, and the resistance heat generation due to the induction current i was not observed. Subsequent 1 and 2 minutes thereafter, electric power of 1,000 KW was applied again, but pinching was produced. Then, electric power was applied again 2.5 minutes after the pouring, the stable heating could be first done under current application. However, such as an ultimely heating as much as 2.5 minutes after the commencement of the pouring does not almost serves to prevent the drop in the temperature of the molten steel in the tundish 1 immediately after pouring, which is intended by the present invention, and the difference ΔT between the lowest temperature and the temperature at which the stationally casting zone is reached is considerably large as shown in FIG. *6b.*

Figure 7A:
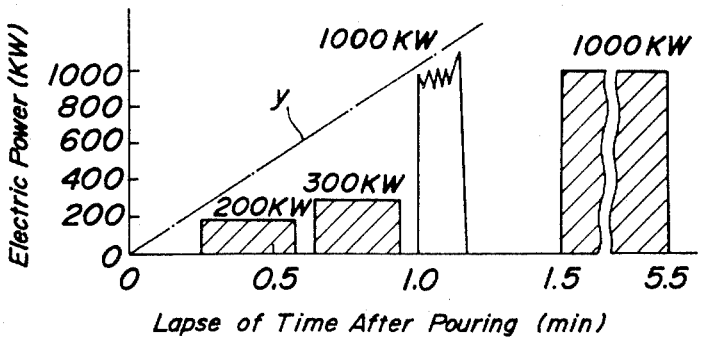
Figure 7B:
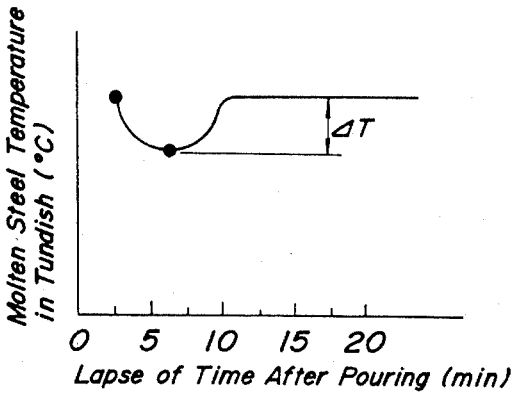
Figure 8A:
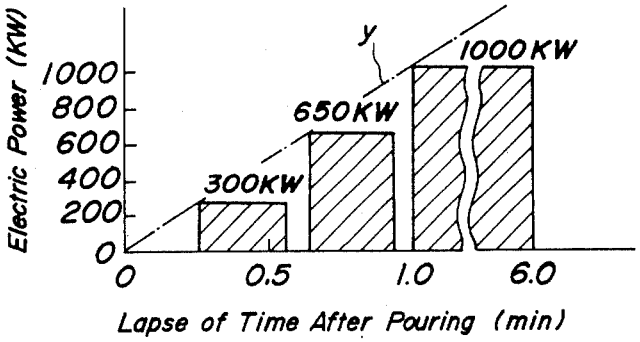
Figure 8B:
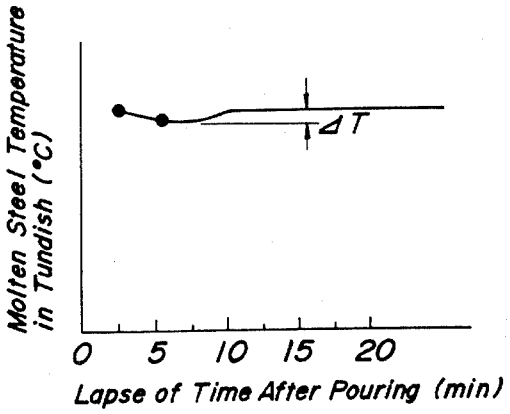

Thus, as shown in FIG. 7, when restricted electric powers of 200 Kw (H: 200 mm) and 300 KW (H: 400 mm) were successivly applied for 17 minutes 0.25 minute and 0.7 minute after the pouring at 7 tons/min. respectively during the pouring at 7 ton/min, and the maximum electric power of 1,000 kw was applied 1 minute after the pouring was commenced, the pinching is still produced. Although the stable heating can be possible under electric current application by reapplying 1.5 minutes after the pouring was commenced, the change of the temperature in the tundish is still insufficient as shown in FIG. *7b,* and the ΔT reaches near −10° C.

Then, as shown in FIG. *8a,* when the electric powers of 300 KW and 650 KW were applied at the lapses of time of 0.2 minute and 0.7 minute for 17 seconds to be in proportion to the pouring lapse time which is in coincidence with the stored amount of the molten metal in the tundish, and the electric power of 1,000 KW was applied 1 minute after the commencement of the pouring, the channel of the molten steel was not interrupted due to the pinching, and the heating under stable electric current application can be done, so that as shown in FIG. *8b,* the reduction in the temperature in the molten steel in the tundish was first decreased to an ignorable degree.

When the preliminary and stepwide electric power application was tried at 800 KW or 950 KW which was in no coincidence with the storage amount of the molten steel deviating from the above-mentioned proportional linearity, the occurrence of the pinching could not be avoided.

In the above examples, when the operation as shown in FIG. *8a* is applied to the tundish 1 with a volume of 7 tons, in which the depth H=600 mm of the steel bath at the time of one minute after the commencement of the pouring which is taken as a time period at which the necessary maximum electric power is applied to the induction heater 2 is deemed as a standard bath surface level, and electric power application pattern corresponding to 30% (300 KW) and 65% (650 KW) of the normal rated electric power 1,000 KW of the induction heater 2 at the points of 200 mm (33% of the standard level) and 400 mm (67%) was applied to the heater 2, casting can be realized as shown in FIG. *8b* free from the interference due to the pinching and with being accompanied by substantial no drop in the temperature of the molten steel in the tundish.

In the above explanation, although tundish of 7 tons in volume was examined, the same may similarly be considered in the case of a tundish of a large volume of 35 tons, or 75 tons, and a so-called consecutively ascending schedule in which the electric power is gradually increased depending upon the stored amount may be adopted. However, since the heat absorption of the refractory material of the inner lining becomes larger and the heat dissipation from the bath surface becomes greater as the volume of the tundish increases, it must be taken into account that the pouring speed in the initial stage is increased to some extent to decrease the above-mentioned ΔT.

In the above description, explanation is made only on the phenomenon at the initial pouring stage, but the technical countermeasure for control of the supply of the electric power into the induction heater depending upon the stored amount of the molten steel in the tundish can be applied as it is even when the depth H of the steel bath varies due to the changes in the bath surface levels seen at the interval of charges in the case that the continuous casting is successively done.

INDUSTRIAL APPLICABILITY

As mentioned above, the method of heating the molten steel according to the present invention can be advantageously applied to the tundish for the continuous steel casting apparatus, and it may also be applied to a metal melt hold vessel with the induction heater other than the tundish in the case where the drop in the temperature due to the conspicuous heat capture, which is inevitably produced with respect to the molten metal received, must be avoided.

What is claimed is:

1. In a method of heating a molten steel in a tundish for a continuous casting apparatus, which method comprises the steps of introducing the molten steel in the tundish into a channel type induction heater, which heater comprises a circular channel provided outside of the tundish and being in communication with the interior of the tundish at opposite ends thereof so as to form a loop shape, and a coil for generating a magnetic flux interlinking with the flow of molten steel passing through the circular channel, and heating the molten steel introduced into and passing through the circular channel by energizing the coil of the induction heater so as to generate induction electric current in the molten steel passing through the circular channel, with jourle's heat being generated thereby, the improvement which comprises controlling electrical power supplied to the induction heater depending upon the stored amount of the molten steel in the tundish, said controlling step comprising supplying electrical power to the induction heater so as to meet the relationship between the depth H mm of a steel bath in the tundish and the induction electric current density D A/cm$^2$/N of the flow of the molten steel passing through the circular channel where $$D \leqq 0.01H + 4.5.$$

* * * * *